US006439928B1

(12) United States Patent
Akama et al.

(10) Patent No.: US 6,439,928 B1
(45) **Date of Patent: *Aug. 27, 2002**

(54) HIGH DENSITY CONNECTOR FOR BALANCED TRANSMISSION LINES

(75) Inventors: Junichi Akama; Hideo Miyazawa; Masahiro Hamazaki, all of Tokyo (JP)

(73) Assignee: Fujitsu Takamisawa Component Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/086,525

(22) Filed: May 29, 1998

(30) Foreign Application Priority Data

May 30, 1997 (JP) ..... 9-141505

(51) Int. Cl.[7] ..... H01R 13/648

(52) U.S. Cl. ..... 439/608; 439/941; 439/74

(58) Field of Search ..... 439/608, 607, 439/74, 609, 610, 108, 101, 92, 95, 660, 65, 67, 77, 83, 941

(56) References Cited

U.S. PATENT DOCUMENTS

| | | | | |
|---|---|---|---|---|
| 3,399,372 A | * | 8/1968 | Uberbacher | 439/60 |
| 3,871,728 A | * | 3/1975 | Goodman | 439/62 |
| 4,762,500 A | | 8/1988 | Dola et al. | |
| 5,024,609 A | * | 6/1991 | Piorunneck | 439/637 |
| 5,195,899 A | | 3/1993 | Yatsu et al. | |
| 5,238,414 A | * | 8/1993 | Yaegashi et al. | 439/108 |
| 5,645,436 A | * | 7/1997 | Shimizu et al. | 439/108 |
| 5,775,947 A | * | 7/1998 | Suzuki et al. | 439/608 |
| 5,813,871 A | * | 9/1998 | Grabbe et al. | 439/108 |
| 5,915,976 A | * | 6/1999 | McHugh | 439/74 |

FOREIGN PATENT DOCUMENTS

| | | |
|---|---|---|
| EP | 0 365 179 | 4/1990 |
| EP | 0 486 298 | 5/1992 |
| EP | 0 563 942 | 10/1993 |
| EP | 0 567 007 | 10/1993 |

OTHER PUBLICATIONS

Horowitz & Hill, "The Art of Electronics," 1985, Cambridge University Press.*

Webster, "Wiley Encyclopedia of Electrical and Electronics Engineering, vol. 1," 1999, John Wiley & Sons.*

Ulaby, "Applied Electromagnetics, 1999 Ed." 1999, Prentice Hall.*

Patent abstracts of Japan, vol. 018, No. 626 (E–1636), Nov. 19, 1994 & JP 06 243936 (Fujitsu Ltd), Sep. 2, 1994.

* cited by examiner

*Primary Examiner*—P. Austin Bradley
*Assistant Examiner*—Ross Gushi
(74) *Attorney, Agent, or Firm*—Staas & Halsey LLP

(57) ABSTRACT

A connector assembly including a jack connector and a plug connector. Each of the jack and plug connectors includes plural pairs of signal contact elements, the pairs being arranged parallel with each other in an array, and the signal contact elements of each of the pairs being arranged opposite to each other; plural ground contact elements, each of which is used as a shield to reduce crosstalk between two parallel the pairs of signal contact elements arranged side by side, the plural pairs of signal contact elements and the plural ground contact elements being alternately arranged in a row; and an electro-insulating body for supporting the signal contact elements and the ground contact elements in a mutually insulated arrangement. It is advantageous that each pair of signal contact elements is used for a balanced transmission line.

12 Claims, 15 Drawing Sheets

HIGH DENSITY CONNECTOR FOR BALANCED TRANSMISSION LINES

BACKGROUND OF THE INVENTION

1. Field of the Invention

The present invention relates generally to an electrical connecting device and, more particularly, to a connector used for high speed transmission lines. The present invention further relates to a connector assembly including such a connector. The present invention is effectively used for connecting balanced transmission lines.

2. Description of the Related Art

Various types of connector systems used for connecting high speed transmission lines are well known in the art. One example of conventional connector systems for high speed transmission includes jack and plug connectors, each of which includes a plurality of signal contacts arranged in several rows in an electro-insulating body. In this type of conventional connector system or assembly, the signal lines structured by the mutually engaged contacts of the mutually assembled jack and plug connectors are partially shielded through the ground potential lines located between the rows of the signal contacts. To this end, each of the jack and plug connectors further includes a row of plural ground contacts arranged between the rows of signal contacts, which act as a shielding to reduce a crosstalk between the rows of signal contacts.

The above conventional connector assembly is effectively used for a single-ended transmission. However, this connector assembly cannot reduce a crosstalk between the signal lines arranged side by side in each row of contacts. Therefore, it is difficult to use this connector assembly for significantly high speed transmission, such as 1 gigabit/sec or more. Also, this structure of connector assembly makes it difficult to reduce a dimension of the insulator body and to increase the density of the signal lines.

Recently, a balanced data transmission system using balanced signals, that is, a differential data transmission system, has been developed for a high speed transmission, and it has been desired to provide a new connector system which can be effectively used for such a balanced data transmission.

SUMMARY OF THE INVENTION

It is therefore an object of the present invention to provide a connector which can be used for significantly high speed transmission.

It is another object of the present invention to provide a connector which can be effectively used for a balanced data transmission system.

It is further object of the present invention to provide a connector assembly including such a connector.

In accordance with the present invention, there is provided a connector, comprising: plural pairs of signal contact elements, the pairs being arranged parallel with each other in an array, and the signal contact elements of each of the pairs being arranged opposite to each other; plural ground contact elements, each of which is used as a shield to reduce a crosstalk between two parallel pairs of signal contact elements arranged side by side, the plural pairs of signal contact elements and the plural ground contact elements being alternately arranged in a row; and an electro-insulating body for supporting the signal contact elements and the ground contact elements in a mutually insulated arrangement.

In the preferred aspect of the present invention, the each pair of signal contact elements is used for a balanced transmission line.

It is advantageous that the profile of a portion of each of the ground contact elements substantially corresponds to a profile of the each pair of signal contact elements.

It is preferred that at least one of the ground contact elements is disposed at at least one of opposed outermost positions in the row.

It is also advantageous that the connector further comprises at least one shield plate disposed outside of the row to reduce crosstalk between the pairs of signal contact elements and the exterior of the connector.

Each pair of signal contact elements may define a jack-type contact pair, and each of the ground contact elements may define a jack contact.

Alternatively, the each pair of signal contact elements may define a plug-type contact pair, and each of the ground contact elements may define a plug contact.

It is also preferred that each of the signal contact elements includes a first contact end adapted to be slidably connected with a counterpart contact of another connector and a second contact end adapted to be fixedly connected with a signal line provided on a circuit board.

In this arrangement, the second contact end may extend parallel to the first contact end.

Alternatively, the second contact end may extend orthogonaly to the first contact end.

Each of the ground contact elements may include a first contact end adapted to be slidably connected with a counterpart contact of another connector and a second contact end adapted to be fixedly connected with a ground provided on a circuit board.

In this arrangement, the second contact end of the each ground contact element may extend parallel to the first contact end of the each ground contact element.

Alternatively, the second contact end of the each ground contact element may extend orthogonaly to the first contact end of the each ground contact element.

In this arrangement, the connector may further include a locator for holding second contact ends of the signal contact elements and of the ground contact elements at mutually spaced positions.

It is also preferred that each of the signal contact elements includes a first contact end adapted to be slidably connected with a counterpart contact of another connector and a second contact end adapted to be fixedly connected with a signal line provided in a cable.

In this arrangement, each of the ground contact elements may include a first contact end adapted to be slidably connected with a counterpart contact of another connector and a second contact end adapted to be fixedly connected with a ground provided in a cable.

In another aspect of the present invention, there is provided a connector assembly, comprising: a jack connector including: plural jack-type pairs of signal contact elements, the jack-type pairs being arranged parallel with each other in an array, and the signal contact elements of each of the jack-type pairs being arranged opposite to each other; plural jack-type ground contact elements, each of which is used as a shield to reduce crosstalk between two parallel jack-type pairs of signal contact elements arranged side by side, the plural jack-type pairs of signal contact elements and the plural jack-type ground contact elements being alternately arranged in a row; and a jack-type electro-insulating body for supporting the jack-type pairs of signal contact elements and the jack-type ground contact elements in a mutually insulated arrangement; a plug connector including: plural plug-type pairs of signal contact elements, the plug-type pairs being arranged parallel with each other in an array, and the signal contact elements of each of the plug-type pairs being arranged opposite to each other; plural plug-type ground contact elements, each of which is used as a shield to reduce crosstalk between two parallel plug-type pairs of signal contact elements arranged side by side, the plural plug-type pairs of signal contact elements and the plural plug-type ground contact elements being alternately arranged in a row; and a plug-type electro-insulating body for supporting the plug-type pairs of signal contact elements and the plug-type ground contact elements in a mutually insulated arrangement; and wherein each of the jack-type pairs of signal contact elements of the jack connector includes a contact end used to be slidably engaged with another contact end of each of the plug-type pairs of signal contact elements of the plug connector; and wherein each of the jack-type ground contact elements of the jack connector includes a contact end used to be slidably engaged with another contact end of each of the plug-type ground contact elements of the plug connector.

It is advantageous that the each jack-type pair of signal contact elements and each plug-type pair of signal contact elements are used for a balanced transmission line.

BRIEF DESCRIPTION OF THE DRAWINGS

The above and other objects, features, and advantages of the present invention will become more apparent from the following description of preferred embodiments in connection with the accompanying drawings, in which.

DESCRIPTION OF THE PREFERRED EMBODIMENT

Figure 1:
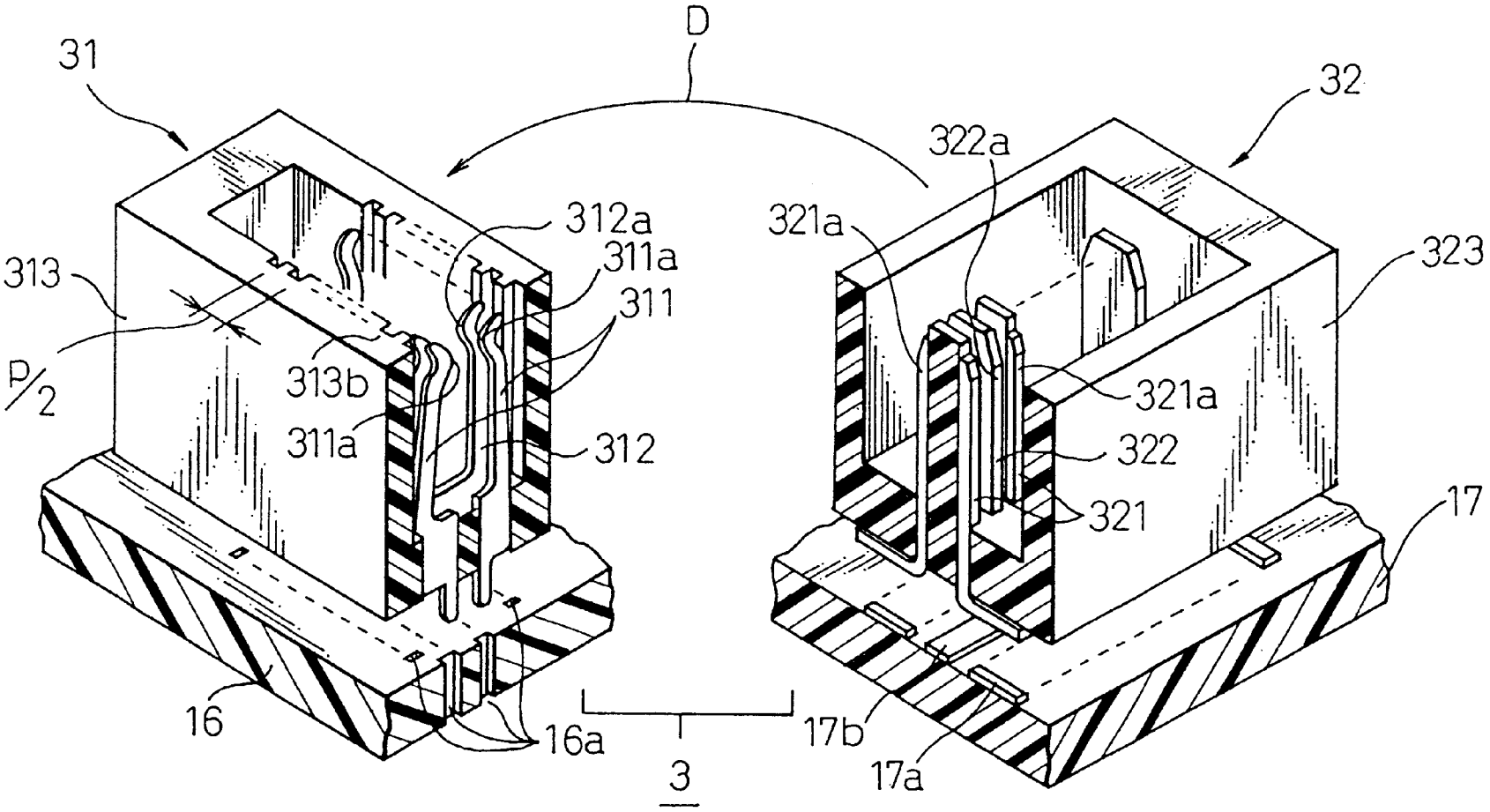
FIG. 1 is a partial cross sectioned, perspective view of a connector assembly, in a separated state, according to a first embodiment of the present invention.

Referring to the drawings, FIG. 2 shows a first embodiment of a connector assembly, according to the present invention, as a high density connector assembly used for high speed transmission. The connector assembly 3 is suitably used for connection between two circuit boards arranged parallel to each other. The connector assembly 3 includes a jack connector 31 and a plug connector 32, which are mounted on circuit boards 16, 17, respectively.

The jack connector 31 includes a plurality of jack-type pairs of signal contact elements 311, a plurality of jack-type ground contact elements 312 and a jack-type electro-insulating body 313. The plural pairs of signal contact elements 311 are arranged in parallel with each other in an array. Each pair of signal contact elements 311 defines a jack contact pair and is used for a balanced transmission line. The plural ground contact elements 312 are also arranged in parallel with each other in an array. The plural pairs of signal contact elements 311 and the plural ground contact elements 312 are alternately arranged in a single row. Each ground contact element 312 is used as a shield to reduce or suppress crosstalk between two pairs of signal contact elements arranged side by side in the row. The jack-type electro-insulating body 313 holds the jack-type pairs of signal contact elements 311 and the jack-type ground contact elements 312, as well as two opposed signal contact elements 311 of each pair, in a mutually insulated arrangement.

The plug connector 32 includes a plurality of plug-type pairs of signal contact elements 321, a plurality of plug-type ground contact elements 322 and a plug-type electro-insulating body 323. The plural pairs of signal contact elements 321 are arranged parallel with each other in an array. Each pair of signal contact elements 321 defines a plug contact pair and is used for a balanced transmission line. The plural ground contact elements 322 are also arranged parallel with each other in an array. The plural pairs of signal contact elements 321 and the plural ground contact elements 322 are alternately arranged in a single row. Each ground contact element 322 is used as a shield to reduce or suppress crosstalk between two pairs of signal contact elements 321 arranged side by side in the row. The plug-type electro-insulating body 323 holds the plug-type pairs of signal contact elements 321 and the plug-type ground contact elements 322, as well as two opposed signal contact elements 321 of each pair, in a mutually insulated arrangement.

Each signal contact element 311 (or a jack signal contact 311) of the jack connector 31 includes a contact end 311*a* used to be slidably engaged with a contact end 321*a* of each counterpart signal contact element 321 (or a plug signal contact 321) of the plug connector 32. Also, each ground contact element 312 (or a jack ground contact 312) of the jack connector 31 includes a contact end 312*a* used to be slidably engaged with a contact end 322*a* of each ground contact element 322 (or a plug ground contact 322) of the plug connector 32.

Figure 2A:
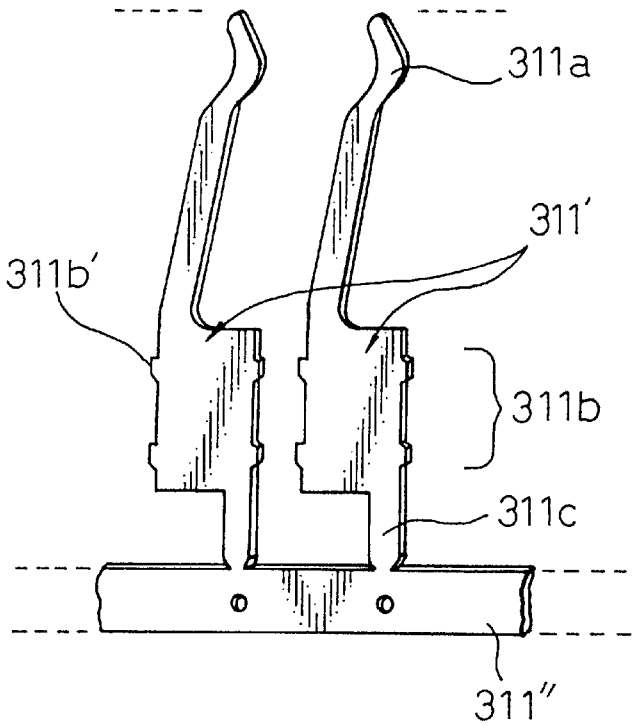
FIGS. 2A and 2B show a signal contact element of the jack connector of the connector assembly of FIG. 1.
Figure 2B:
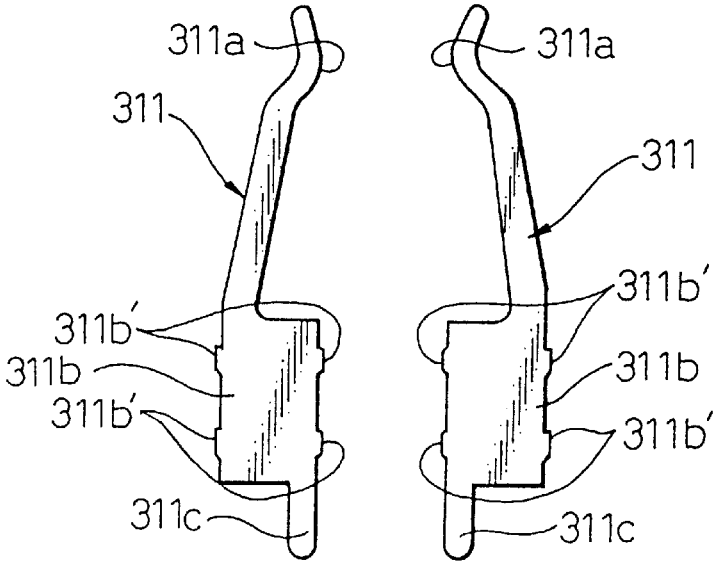

FIG. 2A shows a blank 311' of the jack signal contact 311, prepared by a conventional press-stamping process, and FIG. 2B shows a detail of the jack signal contact 311 obtained from the blank 311'. A plurality of blanks 311' are joined together by a connecting part 311" into a comb shape. The jack signal contact 311 includes the contact end 311*a* formed along an edge of one end portion of the contact 311, which is curved convexly toward one lateral side of the contact 311, an intermediate, insulator engagement section 311*b* adjacent to the contact end 311*a*, and an external terminal 311*c* adjacent to the section 311*b* at the other end of the contact 311. A narrow extension having the contact end 311*a* extends from the engagement section 311*b* along one lateral edge of the section 311*b*, and another narrow extension having the external terminal 311*c* extends oppositely from the engagement section 311*b* along the other lateral edge of the section 311*b*.

In the blank 311', the external terminal 311*c* is joined to the connecting part 311", and thus the contact 311 is formed by cutting off the external terminal 311*c* from the connecting part 311". The engagement section 311*b* is provided at both lateral edges thereof with two pairs of bulges or projections 311*b*', which act to fasten the engagement section 311*b* to the jack-type electro-insulating body 313 (or a jack insulator 313).

Figure 3:
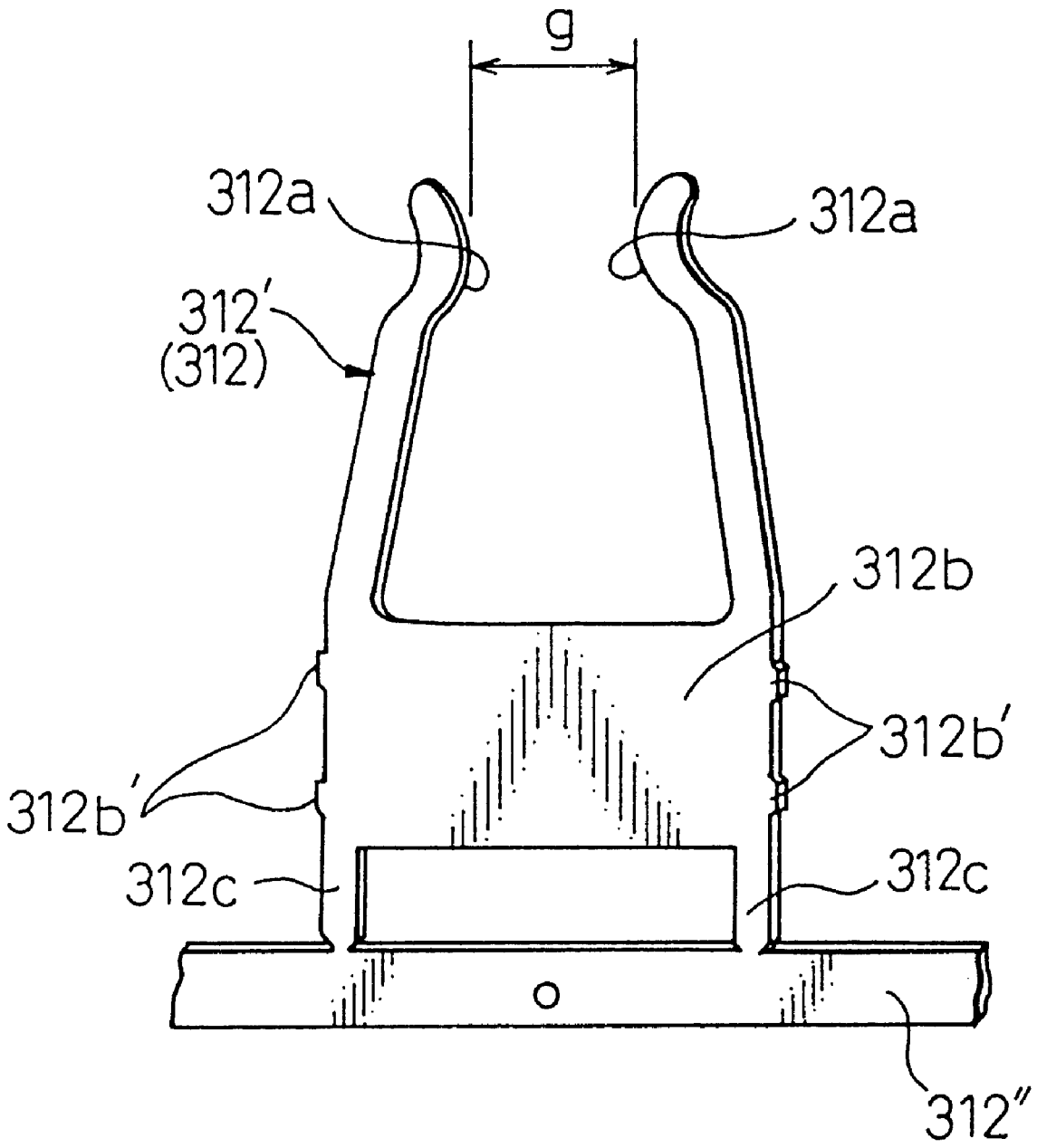
FIG. 3 shows a ground contact element of the jack connector of the connector assembly of FIG. 1.

FIG. 3 shows a blank 312' of the jack ground contact 312, prepared by a conventional press-stamping process. A plurality of blanks 312' are joined together by a connecting part 312" into a comb shape. The jack ground contact 312, obtained from the blank 312', includes a pair of contact ends 312*a*, each of which has a same shape and structure as the contact end 311*a* of the jack signal contact 311 and thus is curved convexly toward the opposed contact, an intermediate, insulator engagement section 312*b* adjacent to the contact ends 312*a*, which has a same size in a longitudinal direction of the contact as the insulator engagement section 311*b* of the jack signal contact 311, and a pair of external terminals 312*c* adjacent to the section 312*b*, each of which has a same shape as the external terminal 311*c* of the jack signal contact 311. Narrower extensions having the contact ends 312*a* extend from the engagement section 312*b* along both lateral edges of the section 312*b*, and narrower extensions having the external terminals 312*c* extend oppositely from the engagement section 312*b* along the both lateral edges of the section 312*b*.

In the blank 312', the external terminals 312*c* are joined to the connecting part 312", and thus the contact 312 is formed by cutting off the external terminals 312*c* from the connecting part 312". The engagement section 312*b* is provided at both lateral edges thereof with two-pairs of bulges or projections 312*b*', which act to fasten the engagement section 312*b* to the jack insulator 313.

A distance "g" between two contact ends 312*a* is selected to be equal to a distance between two contact ends 311*a* of one pair of opposed jack signal contacts 311 inserted into opposed slits 313*d* (FIG. 4A) formed in the jack insulator 313. Also, the length of each extension having the contact end 312*a* and the length of each external terminal 312*c* of the jack ground contact 312 are substantially equal, respectively, to the length of extension having the contact end 311*a* and the length of external terminal 311*c* of the jack signal contact 311.

That is, in the jack connector 31, each of the ground contact elements 312 has a portion, a profile of which substantially corresponds to a profile of each pair of signal contact elements 311. Therefore, each ground contact element 312 can overlap two pairs of signal contact elements 311 arranged side by side in the row in the jack insulator 313, and thus acts as a shield to reduce or suppress crosstalk between the two pairs of signal contact elements 311.

Figure 4A:
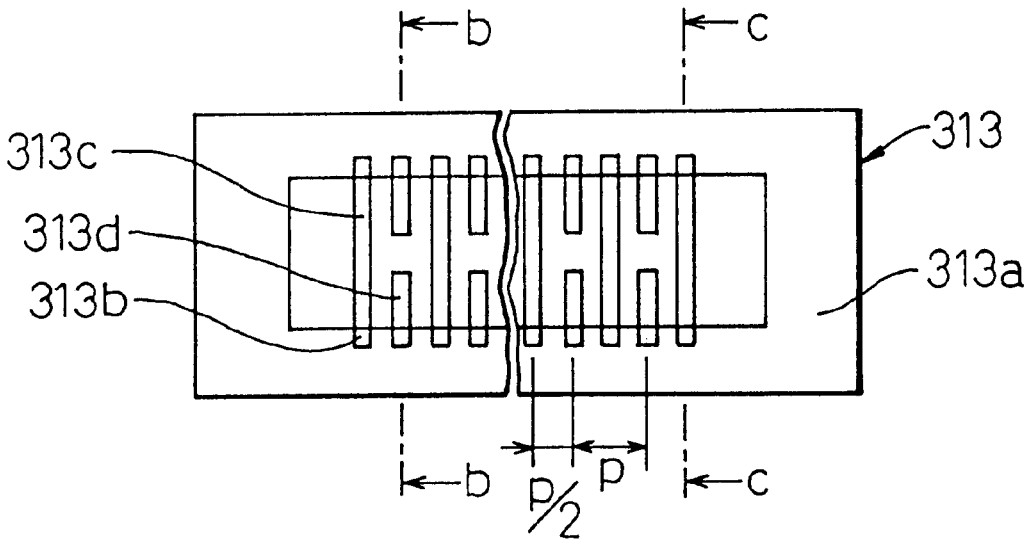
FIG. 4A is a plan view of an electro-insulating body of the jack connector of FIG. 1.
Figure 4B:
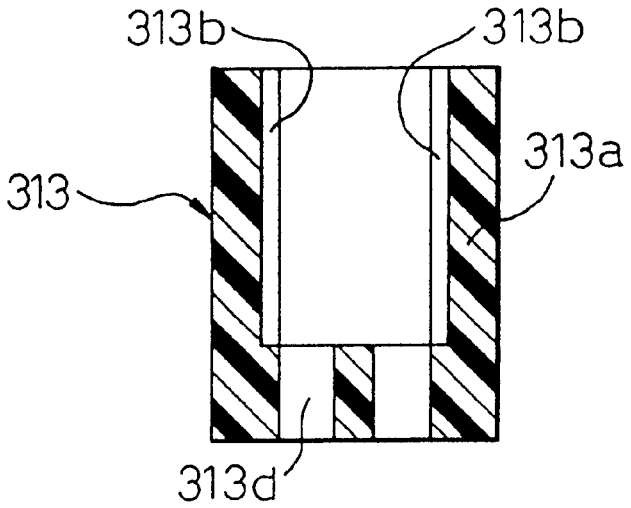
FIG. 4B is a sectional view taken along line b—b of FIG. 4A.
Figure 4C:
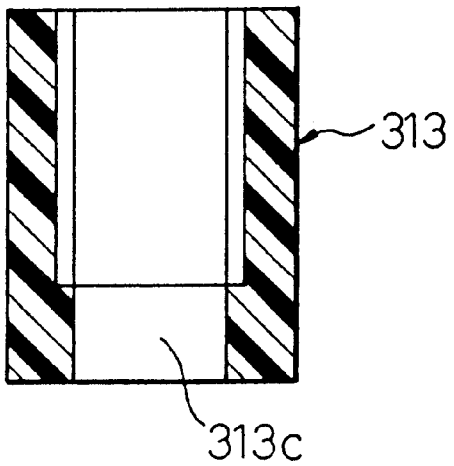
FIG. 4C is a sectional view taken along line c—c of FIG. 4A.

FIGS. 4A to 4C show the jack insulator 313 in a plan view, a b—b section and a c—c section, respectively. The jack insulator 313 is shaped as a bottomed box provided with a peripheral wall 313*a* having a height slightly larger than the length of each extension for the contact end 311*a*, 312*a* of the jack signal contact 311 and the jack ground contact 312. On the longitudinal, inner opposed surfaces of the peripheral wall 313*a*, a plurality of grooves 313*b*, extending from the open end to the inner surface of the bottom wall of the insulator 313, are formed in parallel to and oppositely aligned to each other in a pitch "p/2" i.e. half the pitch "p" of the plural pairs of the jack signal contact 311.

In the bottom wall of the insulator 313, a plurality of slits 313*c*, 313*d* are formed to penetrate the bottom wall and to be aligned with the respective grooves 313*b*. Each slit 313*c*, 313*d* has a same thickness as the each groove 313*b*, and the thickness of each of the slits 313*c*, 313*d* and grooves 313*b* is slightly larger than the thickness of each of the jack signal and ground contacts 311, 312. Each of the larger slits 313*c* extends laterally between opposed grooves 313*b* and can fixedly receive the engagement section 312*b* of the jack ground contact 312, and each of the smaller slits 313*d* extends laterally from respective one of remaining grooves 313*b* to a midway of the bottom wall and can fixedly receive the engagement section 311*b* of the jack signal contact 311. The plural larger slits 313*c* and the plural pairs of opposed smaller slits 313*d* are alternately arranged in a row.

Figure 5A:
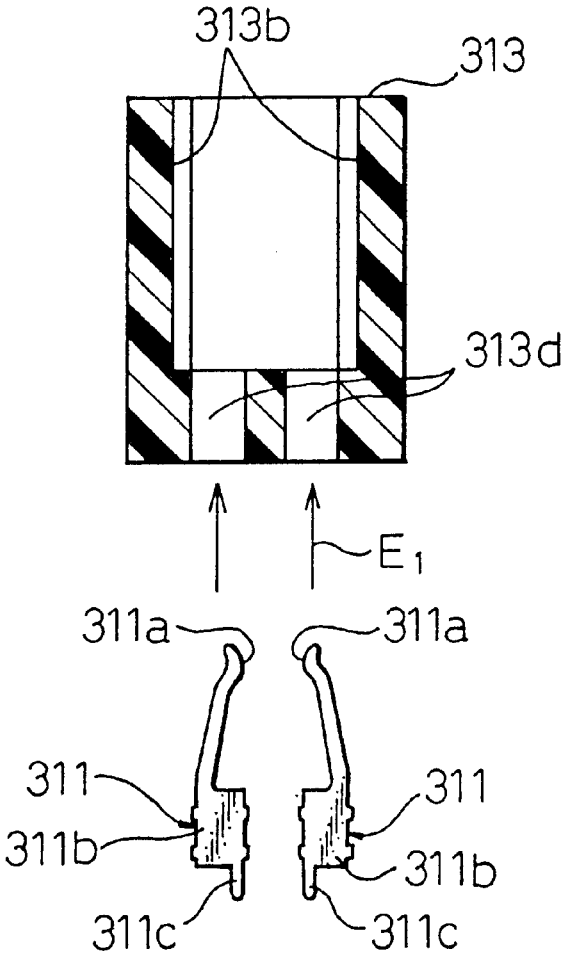
FIG. 5A is a sectional view for illustrating the assembling process of the jack connector of FIG. 1.
Figure 5B:
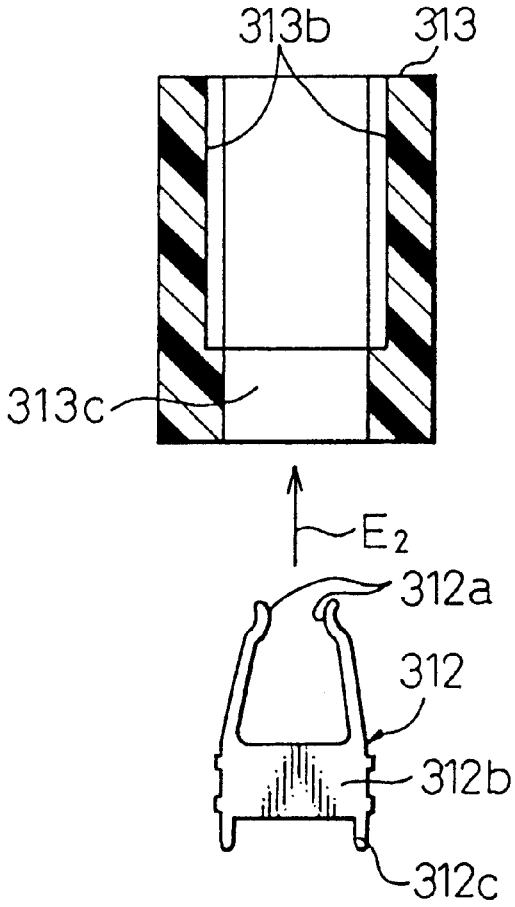
FIG. 5B is a sectional view for illustrating the assembling process of the jack connector of FIG. 1.

As shown in FIGS. 5A and 5B, the plural pairs of jack signal contacts 311 are inserted into the respective slits 313*d*, in such an arrangement that the contact ends 311*a* of each pair are opposed to each other, with the contact ends 311*a* being leading ends in a direction shown by an arrow $E_1$, and the engagement sections 311*b* are press-fit in the slits 313*d*. Also, the plural jack ground contacts 312 are inserted into the respective slits 313*c* with the contact ends 312*a* being leading ends in a direction shown by an arrow $E_2$, and the engagement sections 312*b* are press-fit in the slits 313*c*.

When the jack ground contacts 312 are fastened into the respective slits 313*c* and the jack signal contacts 311 are fastened into the respective slits 313*d*, the contact ends 311*a* of the jack signal contacts 311 are aligned with each other in the longitudinal direction of the jack insulator 313.

In the jack connector 31 of the first embodiment assembled in this manner, the contact ends 311*a* of the jack signal contacts 311 and the contact ends 312*a* of the jack ground contacts 312 are aligned with each other in the direction of the row of these contacts 311, 312 while maintaining the distance "g" between the opposed pair of contact ends 311*a*, 312*a*. On the other hand, the external terminals 311*c* of the jack signal contacts 311 and the external terminals 312*c* of the jack ground contacts 312 are arranged in a staggered manner in four separate rows of the terminals 311*c*, 312*c*.

The circuit board 16 (FIG. 1) is provided with a plurality of through holes 16*a* in an array corresponding to the staggered array of the terminals 311*c*, 312*c*. Accordingly, it is possible to mount the jack connector 31 on the surface of the circuit board 16 by inserting the terminals 311*c*, 312*c* into the respective through holes 16*a*. Then, the terminals 311*c* of the jack signal contacts 311 are fixedly connected with signal lines provided on the circuit board 16, and the terminals 312*c* of the jack ground contacts 312 are fixedly connected with a ground provided on the circuit board 16.

Figure 6:
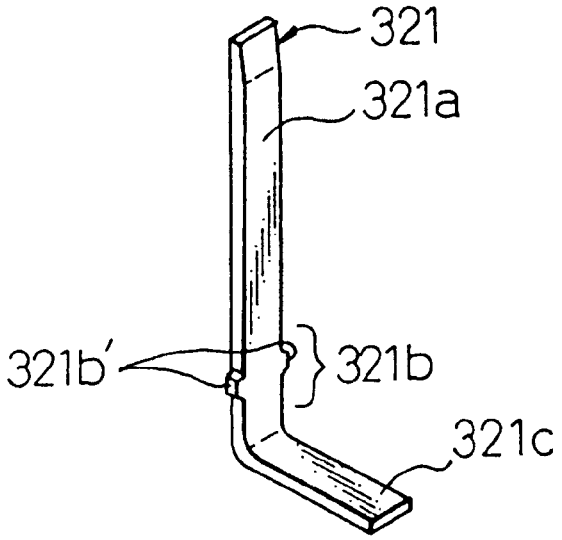
FIG. 6 is a perspective view of a signal contact element of the plug connector of the connector assembly of FIG. 1.

FIG. 6 shows a detail of the plug signal contact 321, prepared by a conventional press-stamping and bending process. The plug signal contact 321 includes the contact end 321*a* formed on a flat surface of one end portion of the contact 321, an intermediate insulator engagement section 321*b* adjacent to the contact end 321*a*, and an external terminal 321*c* adjacent to the section 321*b* at the other end of the contact 321. An extension having the contact end 321*a* extends from the engagement section 321*b* parallel to the section 321*b*, and another extension having the external terminal 321*c* extends oppositely from the engagement section 321*b* orthogonally to the section 321*b*.

The plug signal contact 321 has a constant lateral size throughout the entire length thereof, which is larger than the thickness of the jack signal contact 311. Also, the extension having the contact end 321*a* has a length shorter than the length of the extension having the contact end 311*a* of the jack signal contact 311. The engagement section 321*b* is provided at both lateral edges thereof with two bulges or projections 321*b*', which act to fasten the engagement section 321*b* to the plug-type electro-insulating body 323 (or a plug insulator 323).

Figure 7:
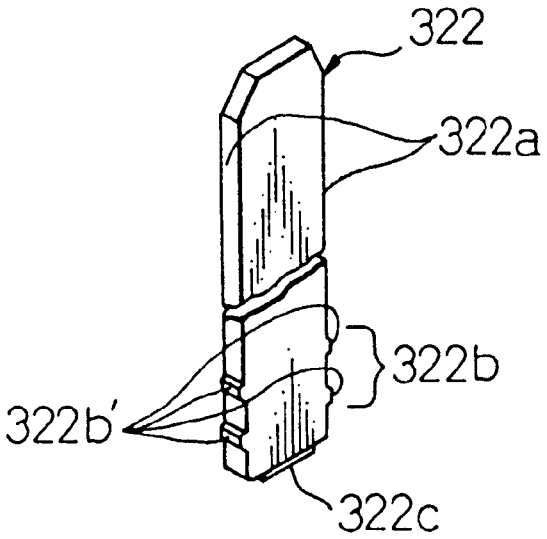
FIG. 7 is a perspective view of a ground contact element of the jack connector of the connector assembly of FIG. 1.

FIG. 7 shows a detail of the plug ground contact 322, prepared by a conventional press-stamping and bending process from a blank material thicker than that of the jack ground contact 312. The plug ground contact 322 includes a pair of contact ends 322*a* formed along opposed lateral edges of one end portion of the contact 322, an intermediate insulator engagement section 322*b* adjacent to the contact ends 322*a*, which has a same size in a longitudinal direction of the contact as the insulator engagement section 321*b* of the plug signal contact 321, and an external terminal 322*c* adjacent to the section 322*b*. An extension having the contact ends 322*a* extends from the engagement section 322*b* parallel to the section 322*b*, and the external terminal 322*c* is formed as a pad on the lower edge of the engagement section 322*b*. The engagement section 322*b* is provided at both lateral edges thereof with two pairs of bulges or projections 322*b*', which act to fasten the engagement section 322*b* to the plug insulator 323.

A lateral distance between two contact ends 322*a* is selected to be equal to a distance between two contact ends 321*a* of one pair of opposed plug signal contacts 321 inserted into opposed slits 323*d* (FIG. 8A) formed in the plug insulator 323. Also, the length of the extension having the contact ends 322*a* is substantially equal to the length of extension having the contact end 321*a* of the plug signal contact 321.

That is, in the plug connector 32, a portion of a profile of each of the ground contact elements 322 substantially corresponds to a profile of each pair of signal contact elements 321. Therefore, each ground contact element 322 can overlap two pairs of signal contact elements 321 arranged side by side in the row in the plug insulator 323, and thus acts as a shield to reduce or suppress crosstalk between the two pairs of signal contact elements 321.

Figure 8A:
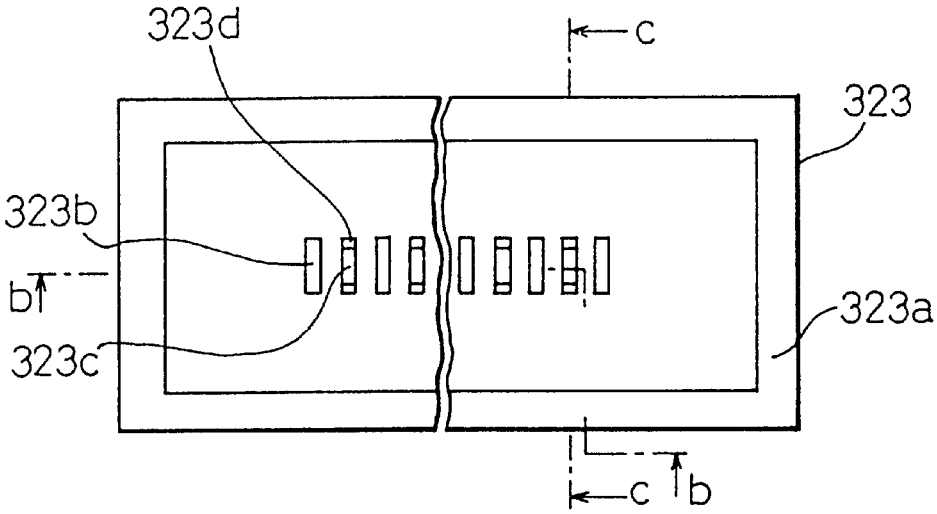
FIG. 8A is a plan view of an electro-insulating body of the jack connector of FIG. 1.
Figure 8B:
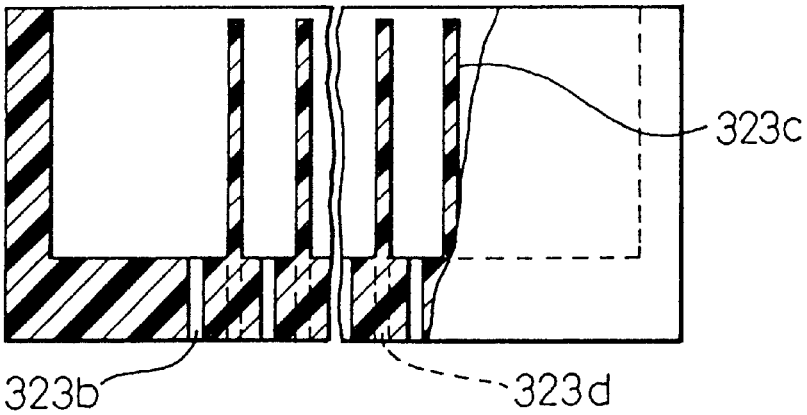
FIG. 8B is a sectional view taken along line b—b of FIG. 8A.
Figure 8C:
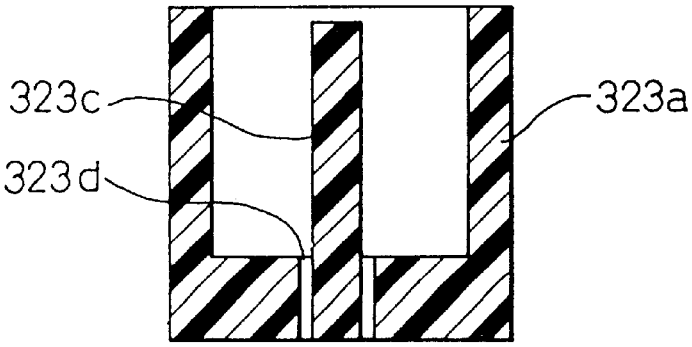
FIG. 8C is a sectional view taken along line c—c of FIG. 8A.

FIGS. 8A to 8C show the plug insulator 323 in a plan view, a b—b section and a c—c section, respectively. The plug insulator 323 is shaped as a bottomed box provided with a peripheral wall 323*a* having a height slightly larger than the length of each extension for the contact end 321*a*, 322*a* of the plug signal contact 321 and the plug ground contact 322. The peripheral wall 323*a* has an inner surface capable of fitting with the outer surface of the peripheral wall 313*a* of the jack insulator 313.

In the bottom wall of the plug insulator 323, a plurality of slits 323*b* are formed to penetrate the bottom wall and to be aligned with the respective slits 313*c* of the jack insulator 313 when the plug insulator 323 is fitted with the jack insulator 313 under an interengagement between the peripheral walls 323*a* and 313*a*. Each slit 323*b* extends laterally in a center region of the bottom wall of the plug insulator 323 and can fixedly receive the engagement section 322*b* of the plug ground contact 322.

Also, in the center region of the bottom wall of the plug insulator 323, a plurality of partition walls 323*c* is formed to project from the bottom wall and to be aligned with the respective slits 313*d* of the jack insulator 313 when the plug insulator 323 is fitted with the jack insulator 313. Each partition wall 323*c* has a height slightly lower than that of the peripheral wall 323*a* and a lateral size slightly smaller than that of the slit 323*b*. On both lateral sides of each partition wall 323*c*, slits 323*d* are formed to penetrate through the bottom wall. Each slit 323*d* can fixedly receive the engagement section 321*b* of the plug signal contact 321. The plural slits 323*c* and the plural pairs of opposed slits 323*d* are alternately arranged in a row.

Figure 9:
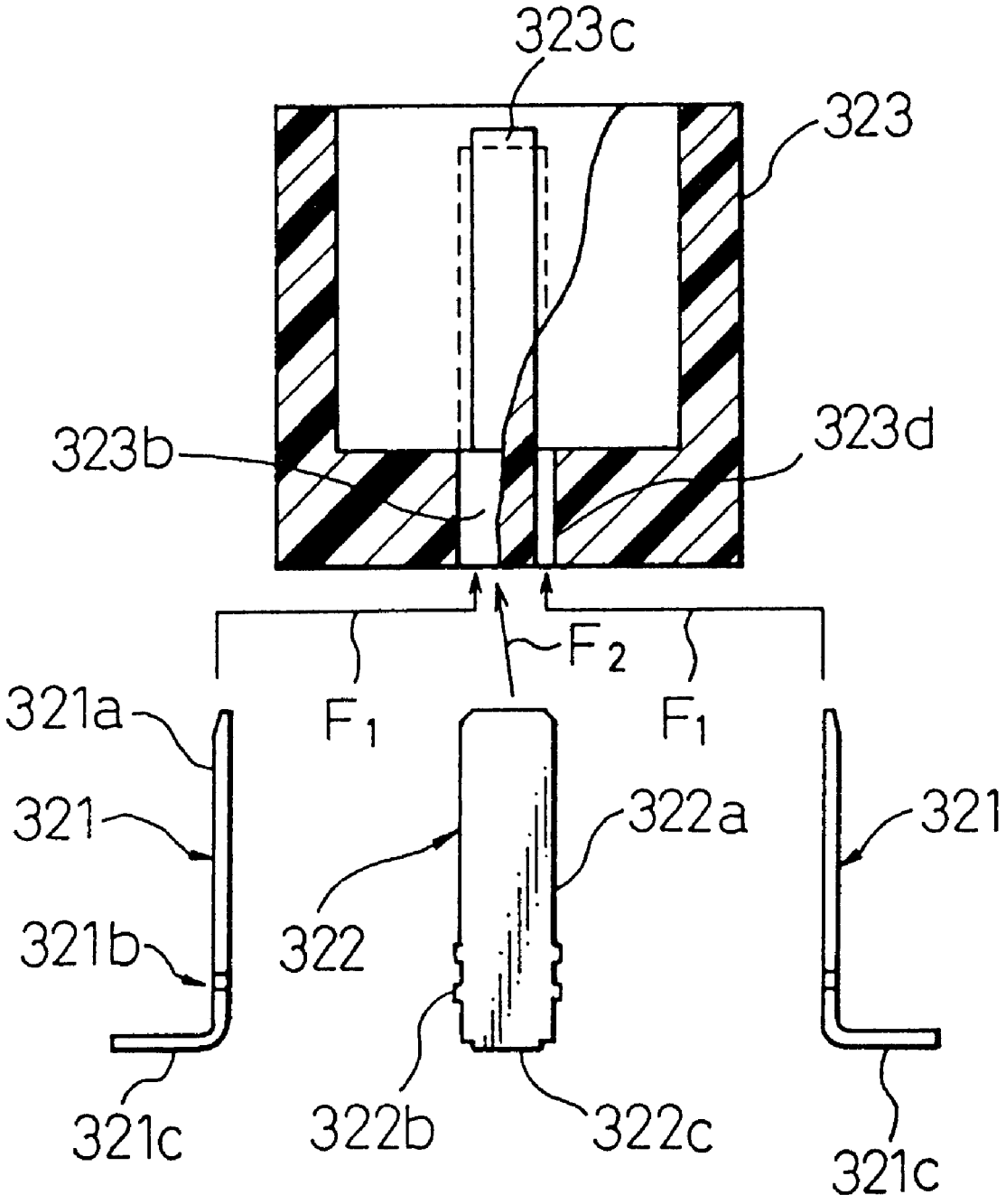
FIG. 9 is a sectional view for illustrating the assembling process of the plug connector of FIG. 1.

As shown in FIG. 9, the plural pairs of plug signal contacts 321 are inserted into the respective slits 323*d*, in such an arrangement that the extensions having the contact ends 321*a* of each pair are abutted onto the opposed side faces of the partition wall 323*c* and the external terminals 321*c* of each pair extend away from each other, with the contact ends 321*a* being leading ends in a direction shown by arrows $F_1$, and the engagement sections 321*b* are press-fit in the slits 323*d*. Also, the plural plug ground contacts 322 are inserted into the respective slits 323*b* with the contact ends 322*a* being leading ends in a direction shown by an arrow $F_2$, and the engagement sections 322*b* are press-fit in the slits 323*b*.

When the plug ground contacts 322 are fastened into the respective slits 323*c* and the plug signal contacts 321 are fastened into the respective slits 323*d*, the contact ends 321*a* of the plug signal contacts 321 are aligned with each other in the longitudinal direction of the plug insulator 323, and the contact ends 322*a* of the plug ground contacts 322 are located between and parallel to the partition wall 323*c*. In the plug connector 32 of the first embodiment assembled in this manner, the contact ends 321*a* of the plug signal contacts 321 and the contact ends 322*a* of the plug ground contacts 322 are aligned with each other in the direction of the row of these contacts 321, 322 while maintaining the distance between the opposed pair of contact ends 321*a*, 322*a*. On the other hand, the external terminals 321*c* of the plug signal contacts 321 and the external terminals 322*c* of the plug ground contacts 322 are arranged, in a staggered manner, in three separate rows of the terminals 321*c*, 322*c*.

The circuit board 17 (FIG. 1) is provided with a plurality of signal electrodes 17*a* and a single ground electrode 17*b* in an array corresponding to the staggered array of the terminals 321*c*, 322*c*. Accordingly, it is possible to mount the plug connector 32 on the surface of the circuit board 17 by putting the terminals 321*c*, 322*c* onto the respective electrodes 17*a*, 17*b*. Then, the terminals 321*c* of the plug signal contacts 321 are fixedly connected with signal electrodes 17*a* provided on the circuit board 17, and the terminals 322*c* of the plug ground contacts 322 are fixedly connected with a ground electrode 17*b* provided on the circuit board 17.

When the plug connector 32 is suitably fitted with the jack connector 31 as shown by an arrow D in FIG. 1, it is possible to provide the high-speed transmission connector assembly 3, wherein the plural pairs of plug signal contacts 321 of the plug connector 32 are connected with the corresponding, plural pairs of jack signal contacts 311 of the jack connector 31, to define plural pairs of signal transmission contact lines, and the plural plug ground contacts 322 of the plug connector 32 are connected with the plural jack ground contacts 312 of the jack connector 31, to define plural ground contact lines.

In such a high-speed transmission connector assembly 3, each ground contact line, structured from the mutually connected jack and plug ground contacts 312, 322, is interposed as a shield between two pairs of signal transmission contact lines, structured from the mutually connected jack and plug signal contacts 311, 321, arranged side by side in the row of contacts, and thereby it is possible to reduce or suppress the crosstalk between the two pairs of signal transmission contact lines. Also, it is possible to eliminate the crosstalk between the laterally opposed signal transmission contact lines of each pair, by connecting these opposed signal transmission contact lines with a balanced transmission line, since the balanced transmission line causes a virtual ground plane between a pair of signal lines used therefor.

Figure 10:
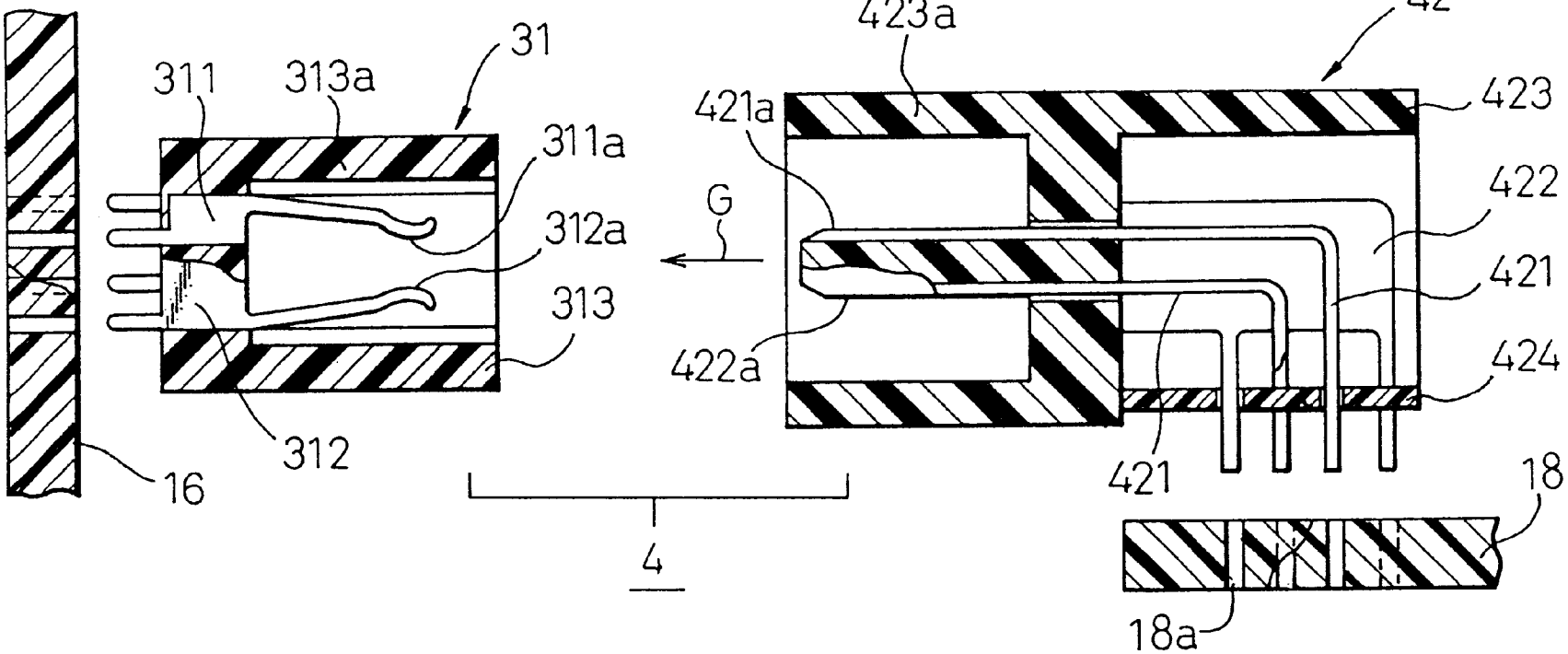
FIG. 10 is a sectional view of a connector assembly, in a separated state, according to a second embodiment of the present invention.

FIG. 10 illustrates a second embodiment of a connector assembly, according to the present invention, as a high density connector assembly used for high speed transmission. The connector assembly 4 is suitably used for connection between two circuit boards arranged orthogonal to each other. The connector assembly 4 includes a jack connector 31 and a plug connector 42, which are mounted on circuit boards 16, 18, respectively.

In this embodiment, the jack connector 31 and the circuit board 16 have a structure identical to those in the first embodiment, and thus the description thereof is not repeated.

The plug connector 42 includes a plurality of plug-type pairs of right-angled signal contact elements 421, a plurality of plug-type right-angled ground contact elements 422 and a plug-type electro-insulating body 423. The plural pairs of signal contact elements 421 are arranged parallel with each other in an array. Each pair of signal contact elements 421 defines a plug contact pair and is used for a balanced transmission line. The plural ground contact elements 422 are also arranged parallel with each other in an array. The plural pairs of signal contact elements 421 and the plural ground contact elements 422 are alternately arranged in a single row. Each ground contact element 422 is used as a shield to reduce or suppress crosstalk between two pairs of signal contact elements 421 arranged side by side in the row. The plug-type electro-insulating body 423 holds the plug-type pairs of signal contact elements 421 and the plug-type ground contact elements 422, as well as two opposed signal contact elements 421 of each pair, in a mutually insulated arrangement.

Each signal contact element 421 (or a plug signal contact 421) includes a contact end 421*a* and an insulator engagement section 421*b*, both having the same structure of the contact end 321*a* and the insulator engagement section 321*b*, respectively, of the plug signal contact 321 of the first embodiment. Also, each ground contact element 422 (or a plug ground contact 422) of the plug connector 42 includes contact ends 422*a* and an insulator engagement section 422*b*, both having the same structure of the contact ends 322*a* and the insulator engagement section 322*b*, respectively, of the plug ground contact 322 of the first embodiment. The description of these same or similar structures of the contacts 421, 422 are not repeated.

Figure 11:
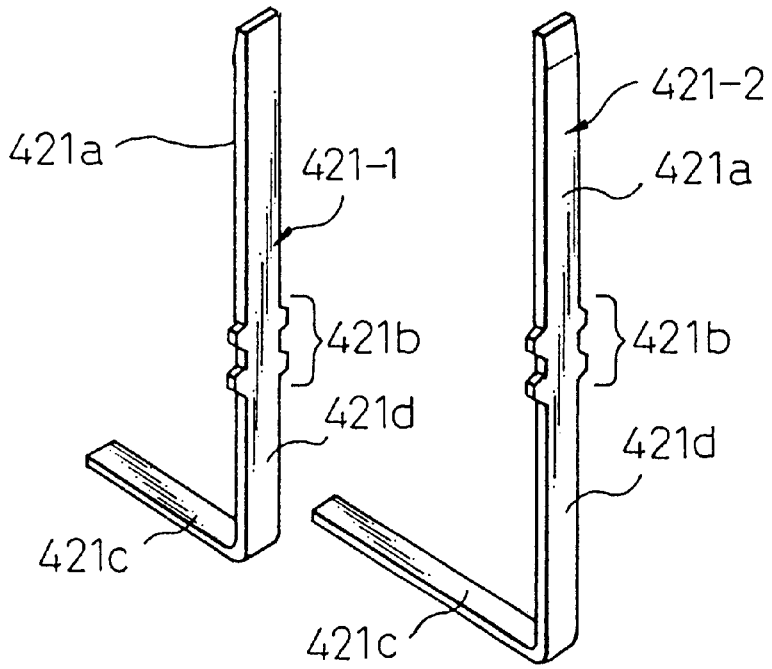
FIG. 11 shows two types of signal contact elements of the plug connector of the connector assembly of FIG. 10.

FIG. 11 shows a detail of the right-angled plug signal contact 421, prepared by a conventional press-stamping and bending process. The right-angled plug signal contact 421 includes the contact end 421*a*, the insulator engagement section 421*b*, and an extension 421*d* adjacent to the section 421*b* and bent at a right angle to define an external terminal 421*c* at the other end of the contact 421. The contact end 421*a* extends parallel to the section 421*b*, and the external terminal 421*c* extends orthogonally to the section 421*b*. Each pair of plug signal contacts 421 includes a shorter one 421-1 having a shorter extension 421*d* and a longer one 421-2 having a longer extension 421*d*.

The right-angled plug signal contact 421 has a constant lateral size throughout the entire length thereof, which is larger than the thickness of the jack signal contact 311. Also, the extension having the contact end 421*a* has a length shorter than the length of the extension having the contact end 311*a* of the jack signal contact 311.

Figure 12:
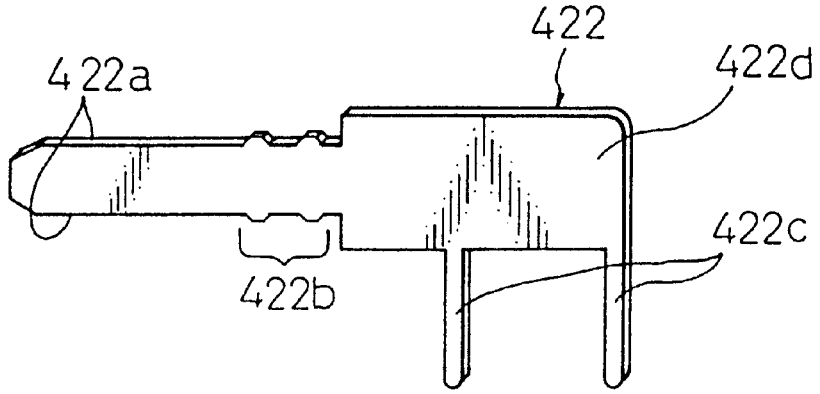
FIG. 12 shows a ground contact element of the plug connector of the connector assembly of FIG. 10.

FIG. 12 shows a detail of the right-angled plug ground contact 422, prepared by a conventional press-stamping and bending process from a blank material thicker than that of the jack ground contact 312. The right-angled plug ground contact 422 includes the pair of contact ends 422*a*, the insulator engagement section 422*b*, and an extension 422*d* adjacent to the section 422*b* and having a pair of external terminals 422*c* extend at a right angle from one lateral side of the section 422*b*. The contact end 422*a* extends parallel to the section 422*b*, and the external terminals 422*c* extend orthogonally to the section 422*b*.

A lateral distance between two contact ends 422*a* is selected to be equal to a distance between two contact ends 421*a* of one pair of opposed plug signal contacts 421 inserted into opposed slits 423*d* (FIG. 13A) formed in the plug-type electro-insulating body 423 (or a plug insulator 423). Also, the length of the extension having the contact ends 422*a* is substantially equal to the length of the extension having the contact end 421*a* of the plug signal contact 421.

That is, in the plug connector 42, a portion of the profile of each of the ground contact elements 422 substantially corresponds to a profile of each pair of signal contact elements 421. Therefore, each ground contact element 422 can overlap two pairs of signal contact elements 421 arranged side by side in the row in the plug insulator 423, and thus acts as a shield to reduce or suppress crosstalk between the two pairs of signal contact elements 421.

Figure 13A:
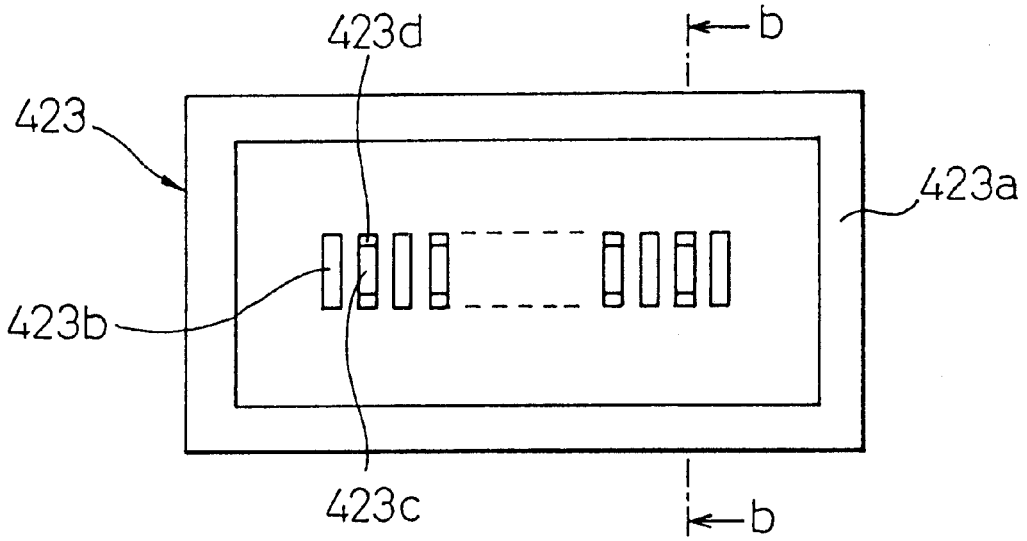
FIG. 13A is a plan view of an electro-insulating body of the plug connector of FIG. 10.
Figure 13B:
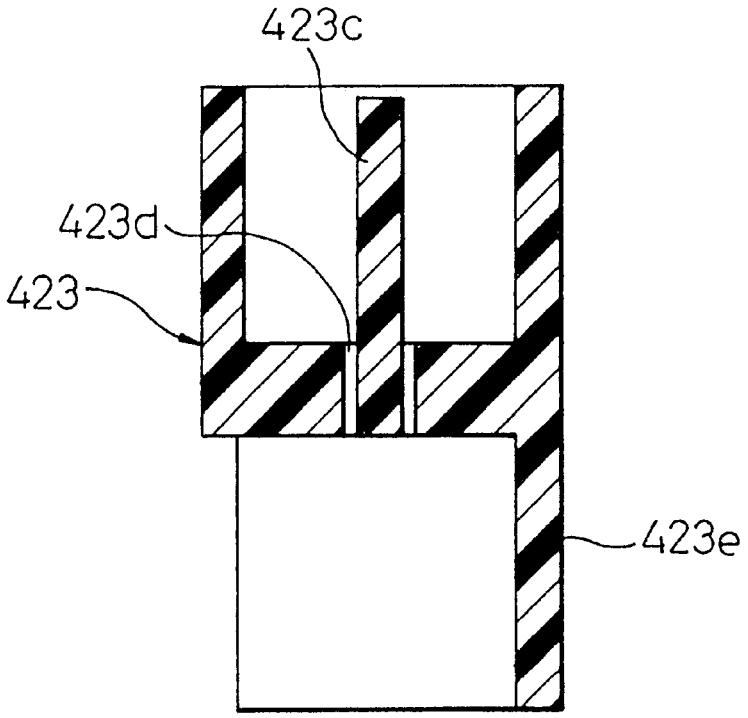
FIG. 13B is a sectional view taken along line b—b of FIG. 13A.

FIGS. 13A and 13B show the plug insulator 423 in a plan view and a b—b section, respectively. The plug insulator 423 has generally the same structure as the plug insulator 323 of the first embodiment, except that an extension wall 423*e* is added to the upper section identical to the plug insulator 323. The extension wall 423*e* extends from the bottom wall of the upper section along three edges of the bottom wall, and acts to cover the right-angled extensions 421*d*, 422*d* of the signal and ground contacts 421, 422 held in positions in the plug insulator 423. The description of the same or similar structures of the plug insulator 423 are not repeated.

Figure 14:
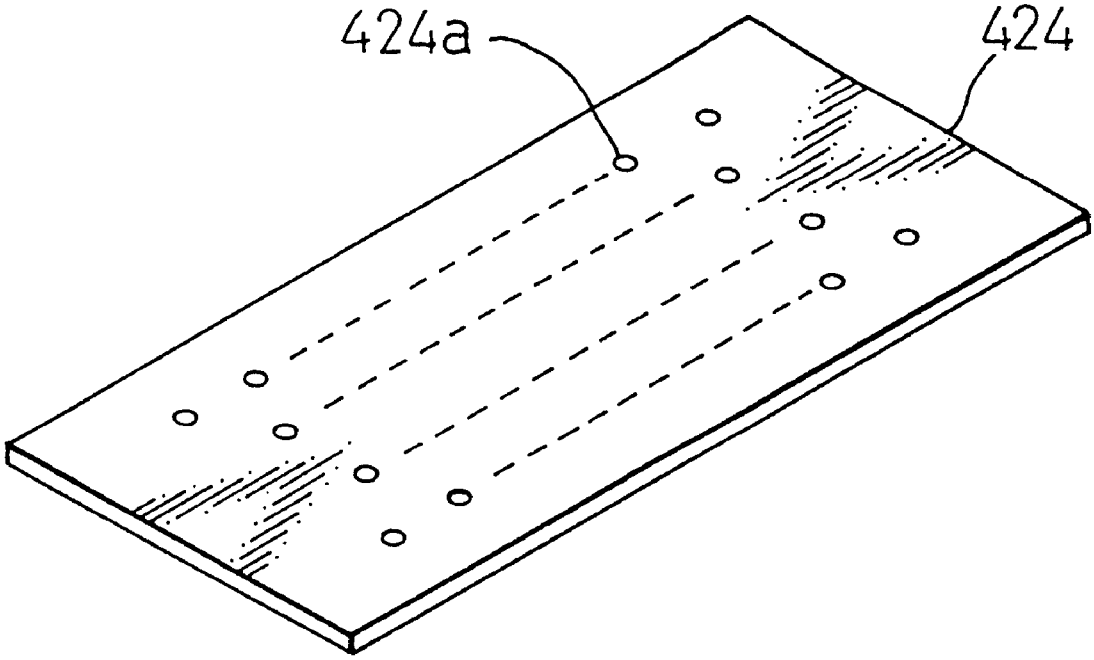
FIG. 14 is a perspective view of a locator of the plug connector of FIG. 10.

The plug connector 42 further includes a locator 424 for positioning and holding the external terminals 421*c*, 422*c* of the right-angled plug signal and ground contacts 421, 422 at mutually spaced positions. As shown in FIG. 14, the locator 424 is shaped as a flat rectangular plate and is mounted to the extension wall 423*e* of the plug insulator 423 along the remaining edge of the bottom wall of the insulator 423. The locator 424 is provided with a plurality of holes 424*a* at positions corresponding to the external terminals 421*c*, 422*c* of the right-angled plug signal and ground contacts 421, 422, both incorporated into the plug insulator 423. Each terminal hole 424*a* has a dimension allowing the external terminal 421*c*, 422*c* to be somewhat loosely inserted into the same.

Figure 15:
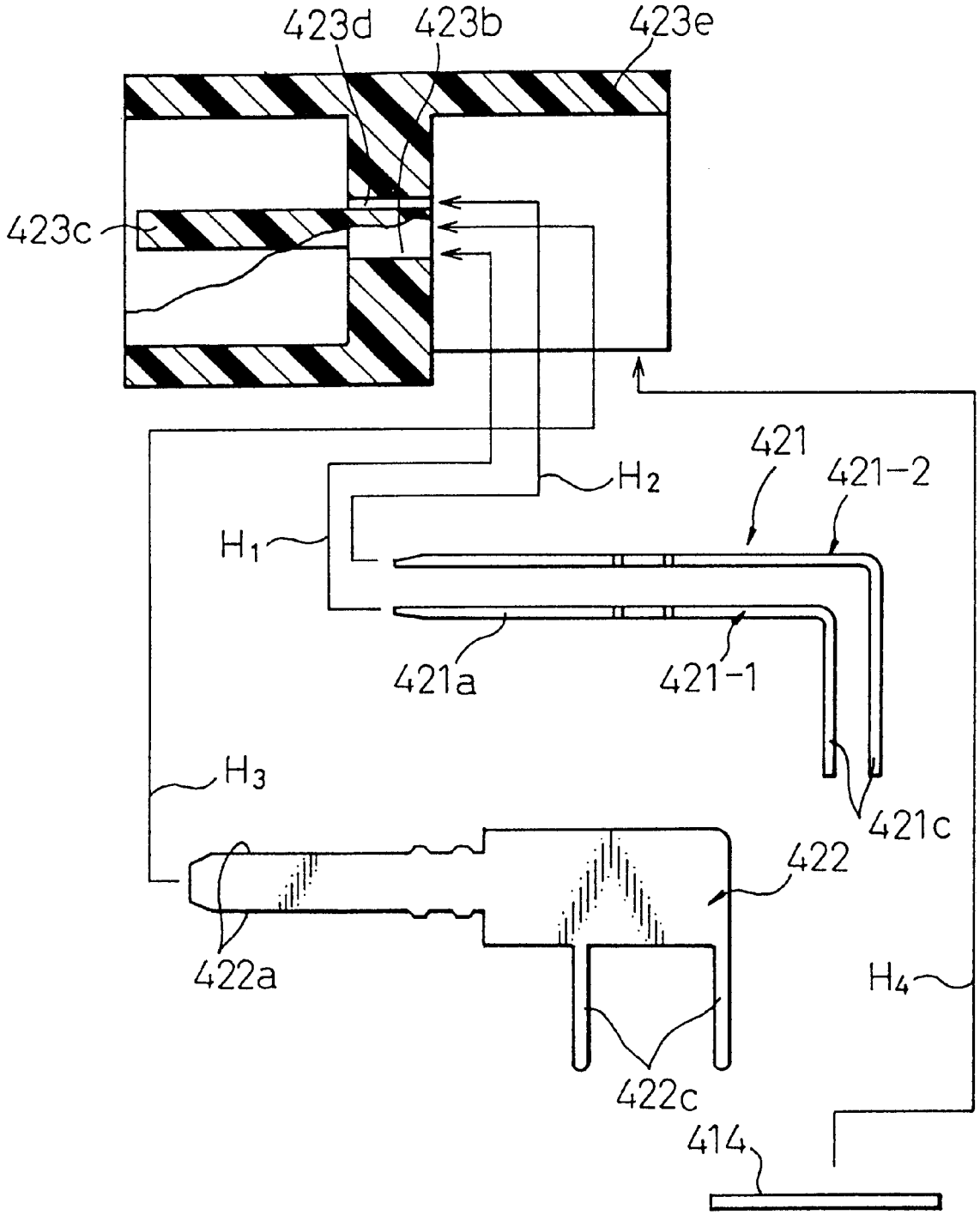
FIG. 15 is a sectional view for illustrating the assembling process of the plug connector of FIG. 10.

As shown in FIG. 15, the plural pairs of right-angled plug signal contacts 421-1, 421-2 are inserted into the respective slits 423*d* of the plug insulator 423, in such an arrangement that the extensions having the contact ends 421*a* of each pair abut the opposed side faces of the partition wall 423*c* and the external terminals 421*c* of each pair are extend in the same direction, with the contact ends 421*a* being leading ends in a direction shown by arrows $H_1$, $H_2$, and the engagement sections 421*b* are press-fit in the slits 423*d*. Also, the plural right-angled plug ground contacts 422 are inserted into the respective slits 423*b* with the contact ends 422*a* being leading ends in a direction shown by an arrow $H_3$, and the engagement sections 422*b* are press-fit in the slits 423*b*.

When the plug ground contacts 422 are fastened into the respective slits 423*c* and the plug signal contacts 421-1, 421-2 are fastened into the respective slits 423*d*, the contact ends 421*a* of the plug signal contacts 421 are aligned with each other in the longitudinal direction of the plug insulator 423, and the contact ends 422*a* of the plug ground contacts 422 are located between, and parallel to, the partition wall 423*c*. In the plug connector 42 of the second embodiment assembled in this manner, the contact ends 421*a* of the plug signal contacts 421 and the contact ends 422*a* of the plug ground contacts 422 are aligned with each other in the direction of the row of these contacts 421, 422 while maintaining a distance between the opposed pair of contact ends 421*a*, 422*a*. On the other hand, the external terminals 421*c* of the plug signal contacts 421 and the external terminals 422*c* of the plug ground contacts 422 are arranged in a staggered manner in four separate rows of the terminals 421*c*, 422*c*.

Then, the locator 424 is mounted to the plug insulator 423 as shown by an arrow $H_4$ at a position for enabling the holes 424*a* of the locator 424 to receive the right-angled terminals 421*c*, 422*c*. In this manner, it is possible to obtain the plug connector 42 as shown in FIG. 10, wherein the external terminals 421*b* of the plug signal contacts 421 and the external terminals 422*b* of the plug ground contact 422*b* are arranged and positioned in a staggered manner.

The circuit board 18 (FIG. 10) is provided with a plurality of through holes 18*a* in an array corresponding to the staggered array of the terminals 421*c*, 422*c*. Accordingly, it is possible to mount the plug connector 42 on the surface of the circuit board 18 by inserting the terminals 421*c*, 422*c* into the respective through holes 18*a*. Then, the terminals 421*c* of the plug signal contacts 421 are fixedly connected with signal lines provided on the circuit board 18, and the terminals 422*c* of the jack ground contacts 422 are fixedly connected with a ground provided on the circuit board 18.

When the plug connector 42 is suitably fitted with the jack connector 31 as shown by an arrow G in FIG. 10, it is possible to provide the high-speed transmission connector assembly 4, wherein the plural pairs of plug signal contacts 421 of the plug connector 42 are connected with the corresponding plural pairs of jack signal contacts 311 of the jack connector 31, to define plural pairs of signal transmission contact lines, and the plural plug ground contacts 422 of the plug connector 42 are connected with the plural jack ground contacts 312 of the jack connector 31 to define plural ground contact lines.

In such a high-speed transmission connector assembly 4, each ground contact line, structured from the mutually connected jack and plug ground contacts 312, 422, is interposed as a shield between two pairs of signal transmission contact lines, structured from the mutually connected jack and plug signal contacts 311, 421, arranged side by side in the row of contacts, and thereby it is possible to reduce or suppress the crosstalk between the two pairs of signal transmission contact lines. Also, it is possible to eliminate the crosstalk between the laterally opposed signal transmission contact lines of each pair, by connecting these opposed signal transmission contact lines with a balanced transmission line, since the balanced transmission line causes a virtual ground plane between the pair of signal lines used therefor.

Figure 16:
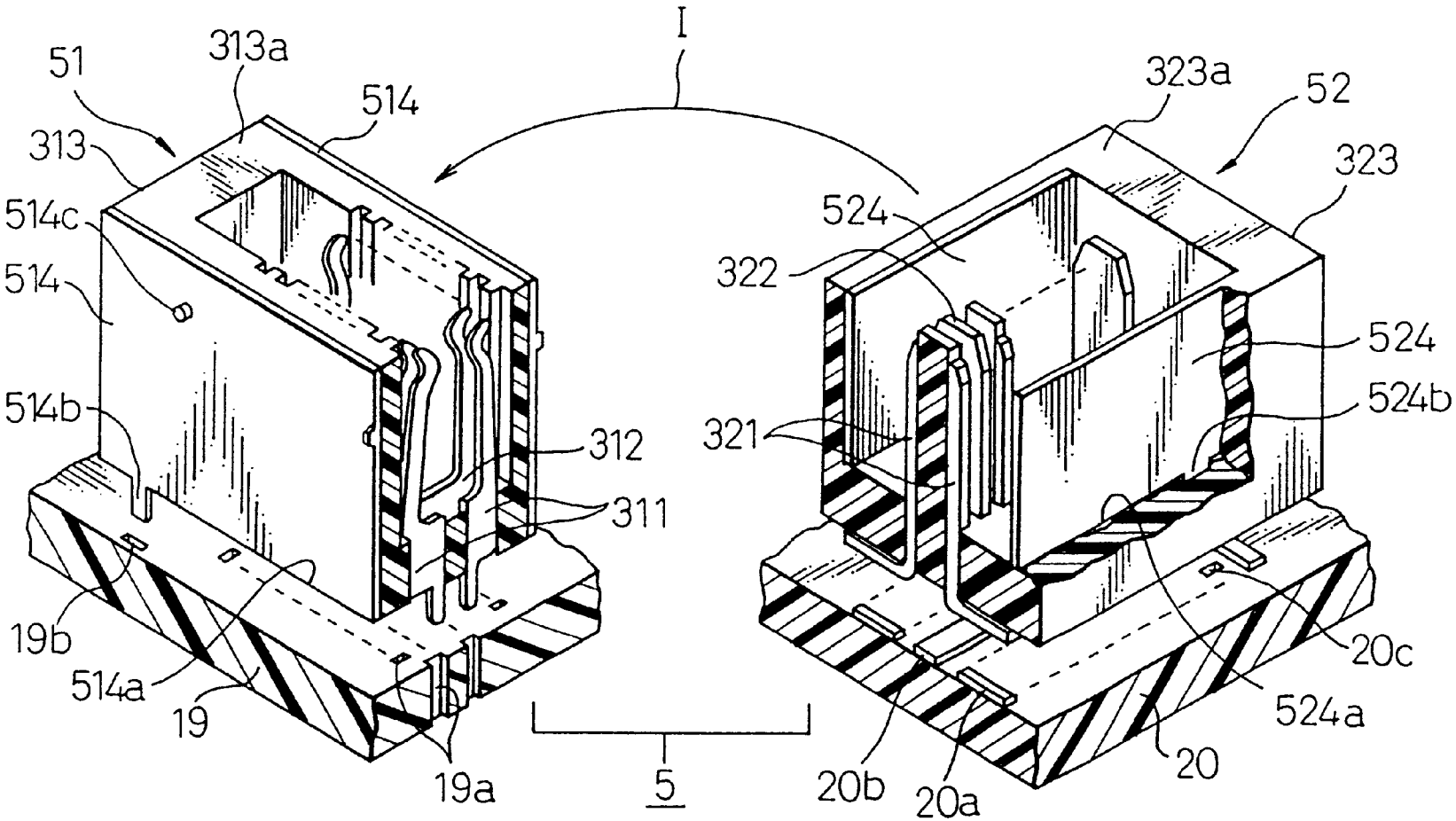
FIG. 16 is a sectional view of a connector assembly, in a separated state, according to a third embodiment of the present invention.

FIG. 16 illustrates a third embodiment of a connector assembly, according to the present invention, as a high density connector assembly used for high speed transmission. The connector assembly 5 is suitably used for connection between two circuit boards arranged parallel to each other. The connector assembly 5 includes a jack connector 51 and a plug connector 52, which are mounted on circuit boards 19, 20, respectively.

In this embodiment, the jack connector 51 and the circuit board 19 have a similar structure to those in the first embodiment, except that separate shielding plates are provided in the jack connector 51. Also, the plug connector 52 and the circuit board 20 have a similar structure to those in the first embodiment, except that separate shielding plates are provided in the plug connector 52. The description of the similar portion is not repeated.

The jack connector 51 of the third embodiment has a pair of first shield plates 514 attached to the respective lateral outer surfaces of the peripheral wall 313*a* of the jack insulator 313. The first shield plates 514 extend alongside the row of the contacts 311, 312 over the entire area of the lateral outer surfaces. The first shield plates 514 may be bonded to the outer surfaces of the jack insulator 313 by, e.g., an adhesive. Each shield plate 514 has a plurality of tongues 514*b* extending from an edge 514*a* thereof towards the circuit board 19 and a plurality of small projections 514*c* formed on an outer surface thereof.

The circuit board 19 is provided with a plurality of through holes 19*a* in an array corresponding to the staggered array of the terminals 311*c*, 312*c* (FIGS. 5A, 5B). The circuit board 19 is also provided with holes 19*b* connected to a ground voltage, at positions corresponding to the tongues 514*b* of the first shield plates 514. Accordingly, it is possible to mount the jack connector 51 on the surface of the circuit board 19 by inserting the terminals 311*c*, 312*c* into the respective through holes 19*a*, and also inserting the tongues 514*b* into the respective holes 19*b*. Then, the terminals 311*c* of the plug signal contacts 311 are fixedly connected with signal lines provided on the circuit board 19, and the terminals 312*c* of the jack ground contacts 312 as well as the tongues 514*b* of the first shield plates 514 are fixedly connected with a ground provided on the circuit board 19.

The plug connector 52 of the third embodiment has a pair of second shield plates 524 attached onto the respective lateral inner surfaces of the peripheral wall 323*a* of the plug insulator 323. The second shield plates 524 extend alongside the row of the contacts 321, 322 over the entire area of the lateral inner surfaces. The second shield plates 524 may be bonded to the inner surfaces of the plug insulator 323 by, e.g., an adhesive. Each shield plate 524 has a plurality of tongues 524*b* extending from an edge 524*a* thereof and penetrating though the bottom wall of the plug insulator 323.

The circuit board 20 is provided with a plurality of signal electrodes 20*a* and ground electrodes 20*b* in an array corresponding to the staggered array of the terminals 321*c*, 322*c* (FIG. 9). The circuit board 20 is also provided with holes 20*c*, connected to a ground voltage, at positions corresponding to the tongues 524*b* of the second shield plates 524. Accordingly, it is possible to mount the plug connector 52 on the surface of the circuit board 20 by putting the terminals 321*c*, 322*c* onto the respective electrodes 20*a*, 20*b*, and inserting the tongues 524*b* into the respective holes 20*c*. Then, the terminals 321*c* of the plug signal contacts 321 are fixedly connected with signal electrodes 20*a* provided on the circuit board 20, the terminals 322*c* of the plug ground contacts 322 are fixedly connected with a ground electrodes 20*b* provided on the circuit board 20, and tongues 524*b* of the second shield plates 524 are fixedly connected with the holes 20*c*.

When the plug connector 52 is suitably fitted with the jack connector 51 as shown by an arrow I in FIG. 16, it is possible to provide the high-speed transmission connector assembly 5, wherein the plural pairs of plug signal contacts 321 of the plug connector 52 are connected with the corresponding, plural pairs of jack signal contacts 311 of the jack connector 51, to define plural pairs of signal transmission contact lines, and the plural plug ground contacts 322 of the plug connector 52 are connected with the plural jack ground contacts 312 of the jack connector 51, to define plural ground contact lines. Also, in this embodiment, when the plug connector 52 is suitably fitted with the jack connector 51, the first shield plates 514 are connected with the second shield plates 524 through the projections 514*c* to define a frame ground surrounding the row of the contact lines.

In such a high-speed transmission connector assembly 5, each ground contact line, structured from the mutually connected jack and plug ground contacts 312, 322, is interposed as a shield between two pairs of signal transmission contact lines, structured from the mutually connected jack and plug signal contacts 311, 321, arranged side by side in the row of contacts, and thereby it is possible to reduce or suppress the crosstalk between the two pairs of signal transmission contact lines. Also, it is possible to eliminate the crosstalk between the laterally opposed signal transmission contact lines of each pair, by connecting these opposed signal transmission contact lines with a balanced transmission line, since the balanced transmission line causes a virtual ground plane between the pair of signal lines used therefor.

Further, it is possible to eliminate the crosstalk between all the signal transmission contact lines and the exterior of the connector assembly 5 by the frame ground structured from the first and second shield plates 514, 524. In this respect, it is preferred that the ground contact line, structured from the mutually connected jack and plug ground contacts 312, 322, is disposed at respective one of opposed outermost positions in the row of the contact lines.

Such shield plates used for the frame ground may also be incorporated into the connector assembly 4 of the second embodiment. In this case, it is apparent that the same effect as in the connector assembly 5 may be obtained.

Figure 17A:
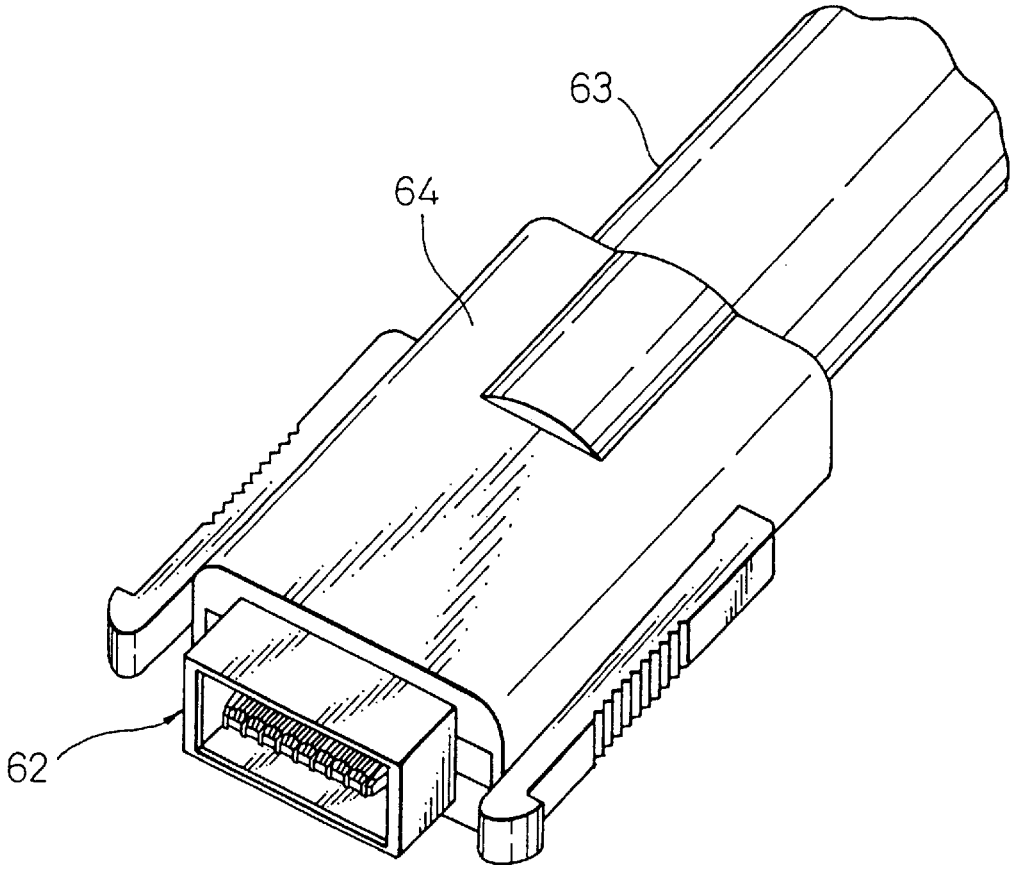
FIG. 17A is a perspective view of a connector, according to another embodiment of the present invention.

FIG. 17A shows another embodiment of a connector, according to the present invention, as a high density connector used for high speed transmission. The connector 62 of this embodiment is suitably used for connection of a balanced transmission cable 63. The structure and function of the connector 62 are similar to those of the plug connectors of the above embodiments, and are not described in detail. The connector 62 may be fixed to the cable 63 by a resinous mold 64.

Figure 17B:
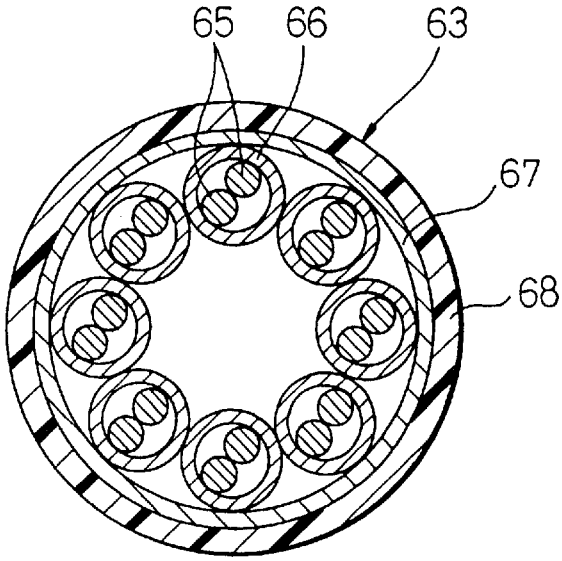
FIG. 17B is a sectional view of a cable.

As shown in FIG. 17B, the balanced transmission cable 63 includes plural balanced transmission lines 65, plural grounds 66 respectively surrounding each balanced transmission line (or a line pair) 65, a shield 67 enclosing all the balanced transmission lines 65 and grounds 66, and a sheath 68 surrounding the shield 67. The signal contact elements of the connector 62 are fixedly connected with the respective balanced transmission lines 65, and the ground contact elements of the connector 62 are fixedly connected with the respective grounds 66.

In the above embodiments of the high speed transmission connectors, the signal contact elements are arranged in two rows. However, the present invention should not be limited thereto, but may be applied to any other connectors having an even number of rows of signal contact elements.

While the invention has been particularly shown and described with reference to preferred embodiments thereof, it will be understood by those skilled in the art that various changes and modifications may be made without departing from the spirit and scope of the invention. The scope of the invention is therefore to be determined solely by the appended claims.

What is claimed is:

1. A connector assembly comprising a pair of connectors connectable with each other:

each of said connectors including:

plural pairs of signal contact elements, said pairs being arranged in a parallel, spaced relationship in an array, and said respective signal contact elements of each of said pairs being arranged in an opposed, spaced relationship;

plural ground contact elements, each of which is arranged between two respective, adjacent pairs of signal contact elements to comprise a shield reducing crosstalk between said respective, adjacent pairs, said plural pairs of signal contact elements and said plural ground contact elements being alternately arranged in a row; and an electro-insulating body supporting said signal contact elements and said ground contact elements in a mutually insulated arrangement, each pair of signal contact elements and an adjacent, parallel ground contact element comprising a balanced transmission line.

2. The connector assembly of claim 1, wherein, in each of said connectors, a portion of each of said ground contact elements has a profile which substantially corresponds to a profile of each of said pairs of signal contact elements such that each ground contact element overlaps each pair of signal contact elements adjacent to said ground contact element.

3. The connector assembly of claim 1, wherein, in each of said connectors, each row has opposite, outermost end positions and at least one of said ground contact elements is disposed at least one of the opposite outermost end positions in said row.

4. The connector assembly of claim 1, each of said connectors further comprising at least one shield plate, disposed outside of said row, reducing crosstalk between said pairs of signal contact elements and an exterior of each connector.

5. The connector assembly of claim 1, wherein each ground contact element comprises a single, unitary shield.

6. A connector assembly having a balanced transmission line structure comprising:

a jack connector having a balanced transmission line structure including:

plural jack-type pairs of signal contact elements, said jack-type pairs being arranged in parallel, spaced relationship in an array, and said signal contact elements of each of said jack-type pairs being arranged in an opposed, spaced relationship, plural jack-type ground contact elements, a portion of each jack-type ground contact element having a profile which substantially corresponds to a profile of each jack-type pair of signal contact elements such that each jack-type ground contact element overlaps each pair of jack-type signal contact elements arranged adjacent to said jack-type ground contact element, said plural jack-type pairs of signal contact elements and said plural jack-type ground contact elements being alternately arranged in a row and each jack-type ground contact element, arranged between two respective, adjacent jack-type pairs of signal contact elements, comprising a shield reducing cross talk between said adjacent jack-type pairs of signal contact elements, and a jack-type electro-insulating body supporting said jack-type pairs of signal contact elements and said jack-type ground contact elements in a mutually insulated arrangement, each said jack-type pair of signal contact elements and an adjacent, parallel ground contact element comprising a balanced transmission line;

a plug connector having a balanced transmission line structure including:

plural plug-type pairs of signal contact elements, said plug-type pairs being arranged in parallel, spaced relationship in an array, and said signal contact elements of each of said plug-type pairs being arranged in an opposed, spaced relationship, plural plug-type ground contact elements, a portion of each plug-type ground contact element having a profile which substantially corresponds to a profile of each plug-type pair of signal contact elements such that each plug-type ground contact element overlaps each plug-type pair of signal contact elements arranged adjacent to said plug-type ground contact element, said plural plug-type pairs of signal contact elements and said plural plug-type ground contact elements being alternately arranged in a row and each plug-type ground contact element, arranged between two respective, adjacent plug-type pairs of signal contact elements, comprising a shield reducing cross talk between said adjacent plug-type pairs of signal contact elements, and a plug-type electro-insulating body supporting said plug-type pairs of signal contact elements and said plug-type ground contact elements in a mutually insulated arrangement, each plug-type pair of signal contact elements and an adjacent, parallel plug-type ground contact element comprising a balanced transmission line, said plug-type electro-insulating body further including plural partition walls, each disposed between respective said signal contact elements of each plug-type pair;

said signal contact elements of each jack-type pair of said jack connector including respective contact ends in a facing, opposed relationship with respect to each other in said jack-type electro-insulating body;

said signal contact elements of each plug-type pair of said plug connector including respective contact ends in facing-away relationship with respect to each other and lying on opposite side faces of a respective said partition wall of said plug-type electro-insulating body, said respective contact ends of said signal contact elements of each jack-type pair being slidingly engageable with said respective contact ends of said signal contact elements of each plug-type pair; and each of said jack-type ground contact elements of said jack connector including two contact ends in facing, opposed relationship with respect to each other, and each of said plug-type ground contact elements including two contact ends in a facing-away relationship with respect to each other, said two contact ends of each jack-type ground contact element being slidingly engageable with said two contact ends of each plug-type ground contact element.

7. The connector assembly of claim 6, wherein:

said jack-type pairs of signal contact elements of said jack connector include corresponding contact ends slidingly engageable with the corresponding contact ends of the respective, matingly engageable plug-type pairs of signal contact elements of said plug connector; and said jack-type ground contact elements of said jack connector include corresponding contact ends slidingly engageable with the corresponding contact ends of the respective, matingly engageable plug-type ground contact elements of said plug connector.

8. The connector assembly of claim 6, wherein each ground contact element comprises a single, unitary shield.

9. A connector assembly having a balanced transmission line structure comprising:

a jack body having an interior recess and a plug body having an interior recess into which the jack body is insertable;

plural pairs of jack-type signal contact elements disposed in a parallel, spaced relationship in a first array within the interior of the jack body;

plural pairs of mating, plug-type signal contact elements, disposed in a corresponding parallel, spaced relationship in a second array within the interior of the plug body and matingly engaged by the respective, plural pairs of jack-type signal contact elements when the jack body is inserted into the interior of the plug body;

plural jack-type ground contact elements disposed in a parallel and alternating relationship with the plural pairs of jack-type signal contact elements in the first array, a portion of each jack-type ground contact element having a profile which substantially corresponds to a profile of each pair of jack-type signal contact elements such that each jack-type ground contact element overlaps each pair of jack-type signal contact elements arranged adjacent to the jack-type ground contact element, each said pair of jack-type signal contact elements and an adjacent, parallel jack-type ground control element comprising a balanced transmission line and each jack-type ground contact element, arranged between two respective, adjacent pairs of jack-type signal contact elements, comprising a shield reducing cross talk between the adjacent pairs of jack-type signal contact elements; and plural, mating plug-type ground contact elements disposed in a parallel and alternating relationship with the plural pairs of plug-type signal contact elements in the second array and matingly engaged by the respective, plural jack-type ground contact elements when the jack body is inserted into the recess of the plug body, a portion of each plug-type ground contact element having a profile which substantially corresponds to a profile of each pair of plug-type signal contact elements such that each plug-type ground contact element overlaps each pair of plug-type signal contact elements arranged adjacent to the plug-type ground contact element, each said pair of plug-type signal contract elements and an adjacent, parallel plug-type ground contract element comprising a balanced transmission line and each plug-type ground contact element, arranged between two respective, adjacent pairs of plug-type signal contact elements, comprising a shield reducing cross talk between the adjacent pairs of plug-type signal contact elements.

10. The connector assembly as recited in claim 9, wherein the jack and plug bodies have respective sidewalls and a bottom wall surrounding and defining the respective recesses therein and the respective jack-type and plug-type signal contact elements and ground contact elements have corresponding end portions extending through the respective bottom walls of the jack and plug bodies, providing external electrical connection terminals.

11. The connector assembly of claim 9, wherein each ground contact element comprises a single, unitary shield.

12. A connector assembly for balanced transmission comprising:

a plug connector having a balanced transmission line structure;

a jack connector having a balanced transmission line structure, said plug connector comprising:

a plurality of pairs of plug-type signal contact elements arranged parallel to each other in a row;

a plurality of plug-type ground contact elements arranged alternately with said plurality of pairs of plug-type signal contact elements in said row, a portion of each plug-type ground contact element having a profile which corresponds substantially to a profile of each of said plug-type signal contact elements such that each plug-type ground contact element overlaps each pair of plug-type signal contact elements adjacent to the plug-type ground contact element and comprises a shield reducing cross talk therebetween, and a plug-type insulating body, made of an electrically insulating material, supporting said plurality of plug-type signal contact elements and said plurality of plug-type ground contact elements, each said pair of plug-type signal contact elements and an adjacent, parallel plug-type ground contact element comprising a balanced transmission line;

said jack connector comprising:

a plurality of pairs of jack-type signal contact elements arranged parallel to each other in a row;

a plurality of jack-type ground contact elements arranged alternately with said plurality of pairs of jack-type signal contact elements in said row, a portion of each jack-type ground contact element having a profile which corresponds substantially to a profile of each of said jack-type signal contact elements such that each plug-type ground contact element overlaps each pair of jack-type signal contact elements adjacent to the jack-type ground contact element and comprises a shield reducing cross talk therebetween; and a jack-type insulating body, made of an electrically insulating material, supporting said plurality of jack-type signal contact elements and said plurality of jack-type ground contact elements, each said pair of jack-type signal contact elements and adjacent, parallel jack-type ground contact element comprising a balanced transmission line; and said jack and plug connectors, when matingly assembled, providing said balanced transmission line connector assembly.

* * * * *